United States Patent [19]

Folk

[11] 4,005,568

[45] Feb. 1, 1977

[54] SELF-CLEANING OPEN-END YARN SPINNING APPARATUS

[75] Inventor: Craig L. Folk, New Orleans, La.

[73] Assignee: The United States of America as represented by the Secretary of Agriculture, Washington, D.C.

[22] Filed: Nov. 18, 1975

[21] Appl. No.: 633,066

[52] U.S. Cl. ..... 57/56; 57/58.95

[51] Int. Cl.[2] ..... D01H 11/00; D01H 1/12

[58] Field of Search ..... 57/34 R, 56, 58.89, 57/58.95

[56] References Cited

UNITED STATES PATENTS

| | | | |
|---|---|---|---|
| 3,126,697 | 3/1964 | Cizek et al. | 57/58.89 |
| 3,334,479 | 8/1967 | Mikulecky et al. | 57/58.89 X |
| 3,354,627 | 11/1967 | Cizek et al. | 57/58.89 X |
| 3,763,641 | 10/1973 | Doublesky et al. | 57/56 |
| 3,798,886 | 3/1974 | Rajnoha | 57/56 |

FOREIGN PATENTS OR APPLICATIONS

| | | | |
|---|---|---|---|
| 1,446,531 | 6/1966 | France | 57/58.89 |
| 1,265,148 | 3/1972 | United Kingdom | 57/58.89 |

*Primary Examiner*—Donald E. Watkins
*Attorney, Agent, or Firm*—M. Howard Silverstein; David G. McConnell; Salvador J. Cangemi

[57] ABSTRACT

This invention relates to an apparatus and method for removing dust and dirt from the process of making yarn in an open-end spinner. It also improves the quality of the finished yarn product. The device comprises a conventional type open-end spinner with a plurality of fine holes critically spaced and installed in the vertex of the V-groove.

4 Claims, 5 Drawing Figures

SELF-CLEANING OPEN-END YARN SPINNING APPARATUS

An apparatus and method for improving open-end spinning of textile yarn is described. More specifically, the improvements of the instant invention concern the elimination of dust particle buildup within the spinner assembly of an open-end yarn spinning apparatus. Such dust is inherent in the raw fiber stock which is used to feed open-end spinners. Improvements by the instant invention also resulted in a wide range of yarn sizes, even above the count of 50S, and the capability of producing yarn at very low processing speeds as well as the higher rotational speeds normally associated with open end spinning.

It has been known in the art of fiber spinning, that textile fibers can be conveyed to an open-end spinner by a moving stream of air. This air stream is produced by a fiber individualizing device wherein the raw fiber stock is combed by a toothed cylinder on a feed roller communicating through a pressure plate. This air stream can be further accelerated by means of a vacuum which is produced either by the pumping action of the spinner or an outside vacuum source connected to a shroud surrounding the spinner assembly.

However, this air must be eliminated efficiently in order for the fibers to be conveyed in a continuous feed manner to the spinners. This need for the air to channel out of the yarn forming area of the spinner has always created difficulties for spinners in the form of back pressures resulting in turbulence and thus improper fiber laying into yarns.

Early models of open end spinners even arranged a few large holes in the peripheral V-groove of the Spinner in an attempt to solve this problem. Other modifications included holes in the adjacent walls of the spinner. These efforts either resulted in failure to discharge sufficient quantities of air, hair pinning of fiber through the large holes or build-up of dirt in the V-groove, and this approach was abandoned by investigator of this problem.

The discovery of the instant invention is that in order to separate the air from the fiber efficiently and continuously, it is necessary to have a sufficient number, size and arrangement of holes capable of discharging all the air which is fed in by the fiber individualizer as well as produce a negative pressure within the spinner. The additional advantage is essentially converting the spinner into a selective filter discharging the dirt, dust, and air, and retaining the clean fiber in the spinner V-groove, thereby producing high quality clean yarn, and eliminates the dirt build up in the spinner which inevitably results in a break down of the yarn formation.

Therefore, it is the primary object of this invention to produce a superior yarn.

is another object of the invention to eliminate excess air from the spinner assembly in an efficient manner.

It is a third object of this invention to eliminate the dust and dirt particles from the fiber fed into the spinner.

It is a fourth object of this invention to prevent dirt and dust build up on the surface of the spinner where fibers are normally built up into yarn.

It is a fifth object of this invention to prevent foreign matter, dirt, and dust build up in the V-groove of the spinner.

It is a sixth object of this invention to provide an apparatus of fiber formation into yarn starting with the spinner in a rest position.

It is a seventh object of this invention to provide a significant pressure differential in the spinner to allow for efficient fiber spinning into yarn.

It is an eighth object of the invention to provide increased range of yarn size.

It is a ninth object of the invention to provide more efficient feeding of fibers to an open end spinner.

It is the tenth object to provide a means to greatly reduce or eliminate "end down" in the O. E. Spinner.

It is the eleventh object of the invention to provide a visual means of observing the formation of yarn in an O. E. Spinner.

It is a twelfth object to provide capability of producing yarn at very low processing speeds as well as higher rotational speeds which are normally associated with open end spinning.

Other objects and advantages of this invention will further become apparent hereinafter and in the drawings in which.

Figure 1:
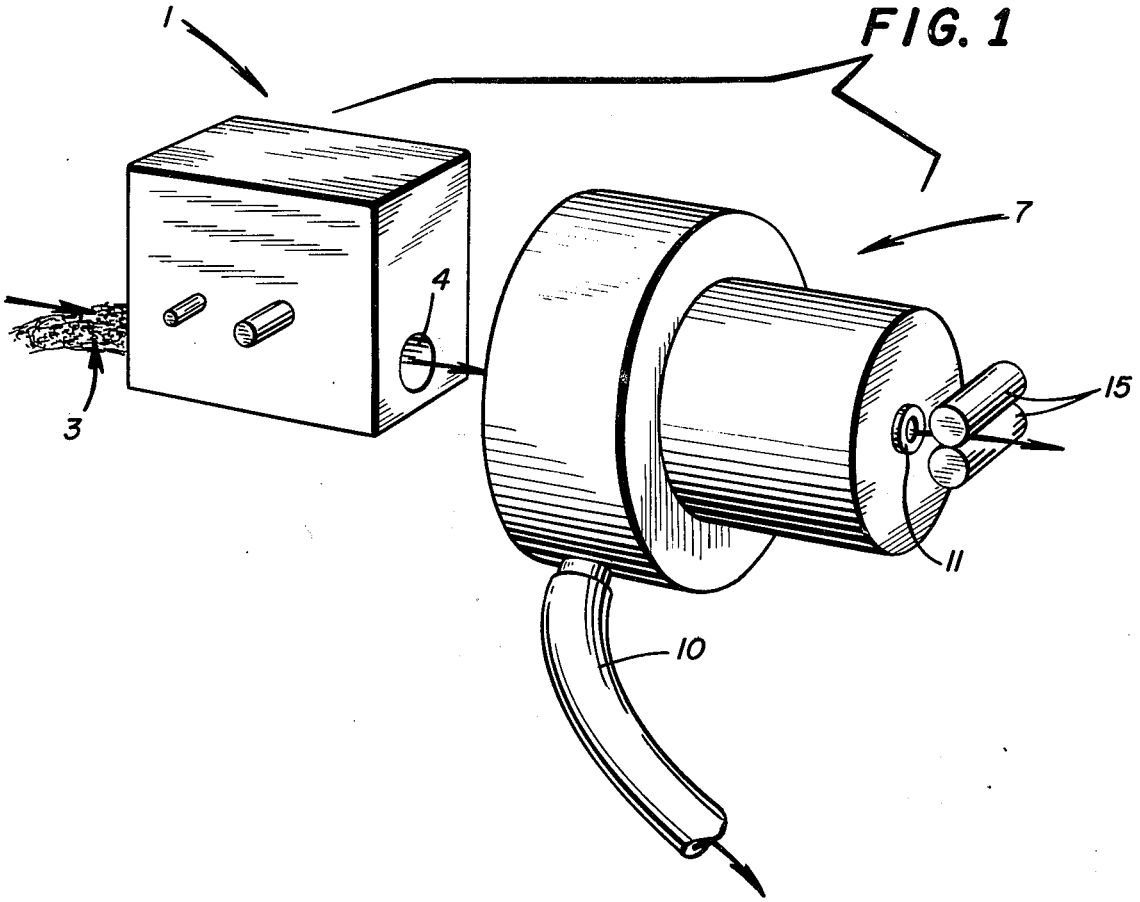
FIG. 1 is a perspective drawing showing a fiber opener, spinning element and yarn removal rollers.

In describing the preferred embodiment of the invention illustrated in the drawings, specific terminology will be resorted to for the sake of clarity. However, it is not intended to be limited to the specific terms so selected, and it is to be understood that each specific term includes all technical equivalents which operate in a similar manner to accomplish a similar purpose.

Figure 2:
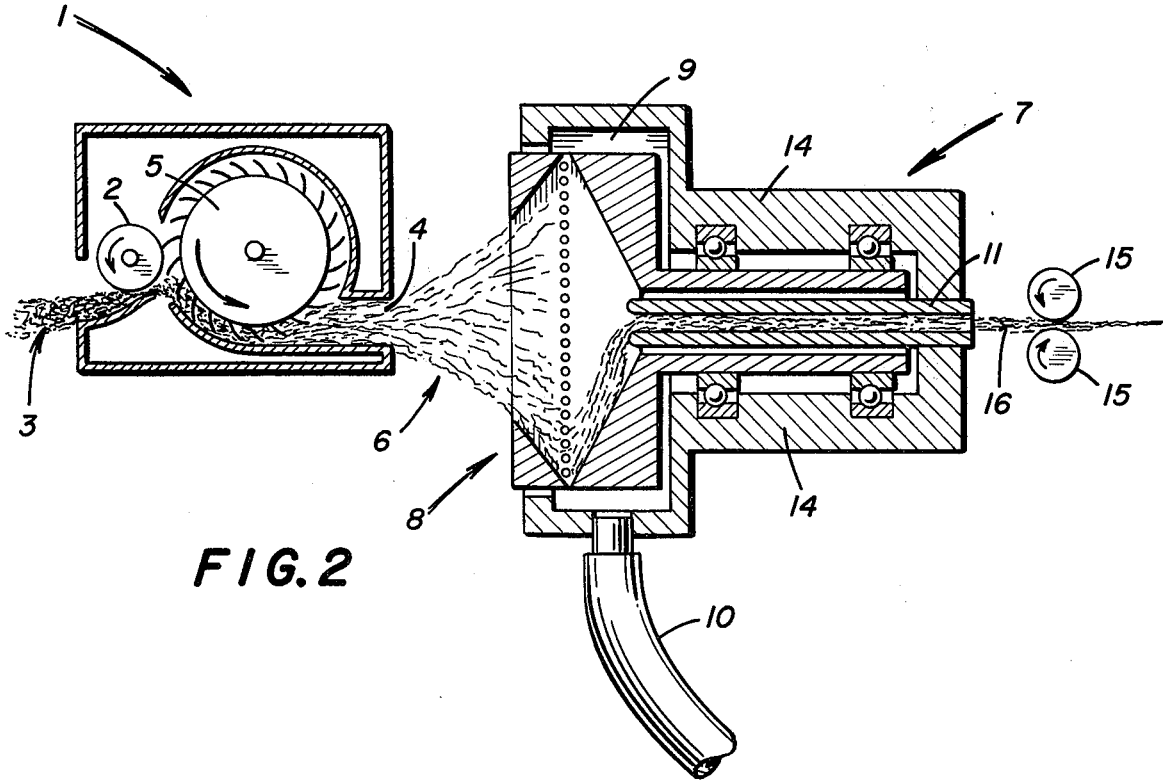
FIG. 2 is a longitudinal section through the horizontal axis of the three elements of FIG. 1.
Figure 3:
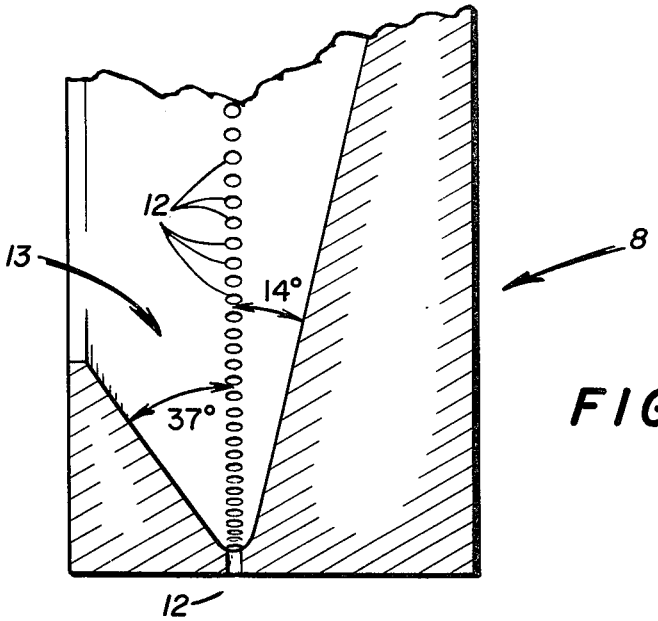
FIG. 3 is an enlarged detail schematically illustrating a section of the spinner disclosing the arrangement and location of the fine holes.

Turning now to the preferred embodiment of the invention illustrated in the drawings, which results in high quality yarn production by an open face, open end spinner depicted in FIGS. 1, 2, and 3 wherein raw fiber stock 3 is introduced into individualizing device 1, FIGS. 1 and 2. Raw fiber feed stock 3 can be either a sliver or any suitable raw feed stock and is fed under roller 2 onto opening cylinder 5 where it is combed and separated. This combing action individualizes the fibers to be fed into the open spinner assembly 7. Individualized fiber 6 is exited through open port 4 where it is combined with an open air stream which is generated by fiber opening cylinder 5. Combed and separated fibers 6 are then drawn into the open face of open end spinner 8. This occurs for several reasons. First, there is an increasing negative pressure toward V-groove 13, FIG. 3. This reduced pressure gradient is achieved by surrounding spinner 8 with a hollow shroud 9, FIG. 2, and evacuating shroud 9 by means of hose 10 which is connected to a vacuum pump (not shown). Second, there is a positive pressure of air and fiber being blown from fiber individualizer 1. The most critical requirement of the instant invention is to locate a plurality/multiplicity of fine holes 12 in the vertex of the V-groove 13 of spinner 8 around the entire periphery. It is advisable that the wall of spinner 8 be designed as thin as possible where holes 12 are located. The thin wall will minimize the pressure drop from spinner 8 to shroud 9 and thereby aid in the elimination of dust and foreign material from combed fiber 6. The instant invention achieves the formation of yarn as well as eliminates the undesirable materials of dust and foreign matter. Yarn is formed by placing a strand 6 into spinner 8 where it is properly formed and fed into hollow stationary tube 11, exiting into yarn removal rollers 15 and finally into a yarn winding device (not shown). Due to the design of the spinner, yarn laid into spinner 8 covers about one-third of the circumference of V-groove 13. In processing yarn it is necessary to first activate the external vacuum source (not shown) before starting all the other elements. Fibers 6 which flow from exit port 4 of fiber individualizer 1 are attracted to V-groove 13 as a result of positive air pressure, vacuum, and centrifugal force. As the fibers are accelerated toward V-groove 13, the leading edge of fiber 6 is traveling faster than the trailing edge of fiber 6. Fiber 6 is thus straightened. As the leading edge of fiber 6 touches the moving vertex of V-groove 13, it is aligned and held in V-groove 13 by both the force of the vacuum on the multiplicity/plurality of fine holes 12 and the centrifugal force of spinner 8. This straightening and aligning of the fibers results in a superior yarn and allows for finer yarns to be spun.

Any dust or foreign material that is traveling with the fibers continues through the multiplicity or plurality of fine holes 12 and is carried away through the vacuum source for collection. During the spinning operation, fibers 6 are assembled in V-groove 13 forming into yarn through the insertion of twist produced by spinner 8's rotation. Simultaneously, take out rollers 15 are continuously removing the newly made yarn 16. The operation of assembling fibers 6 covers only a portion of the circumference of V-groove 13. The area of V-groove 13 directly behind newly formed yarn 16 is clear of fibers 6 thus leaving holes 12 exposed. The space directly above the exposed holes has the highest negative pressure, and thus the incoming fibers 6 are attracted to this portion of spinner 8. It is through this means of controlled fiber placement that a more superior yarn is produced. In conventional spinners fibers are placed randomly within the spinner without regard to yarn assembly operation. Thus, many fibers are deposited on top of the assembled yarn causing warp arounds and hairy yarn. The instant invention has the unique ability to eliminate both of these problems.

Therefore, in the embodiment described above, the instant invention both spins with improved ability as well as cleans the foreign dust and dirt from the fibers. In this embodiment of the instant invention the diameter of the plurality of fine holes is set at approximately 0.018 inches. The plurality of fine holes is limited to approximately 200 holes equally spaced around the V-groove of the spinner. Continuous and persistant testing disclosed that this was approximately the correct amount and size of holes to achieve quality yarn over a wide range of yarn sizes.

Figure 4:
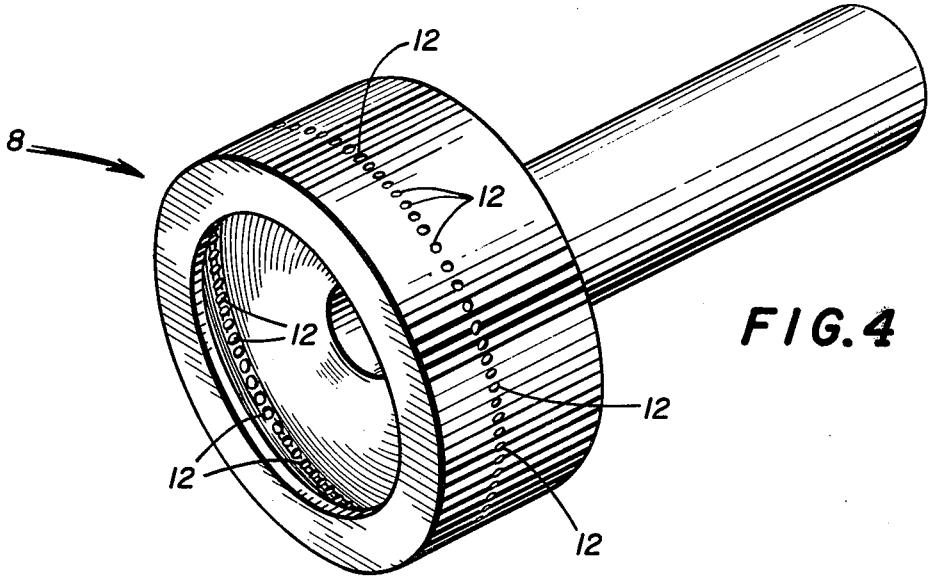
FIG. 4 is a perspective drawing of a conventional open end spinner describing the plurality of fine holes which act as a selective filter.
Figure 5:
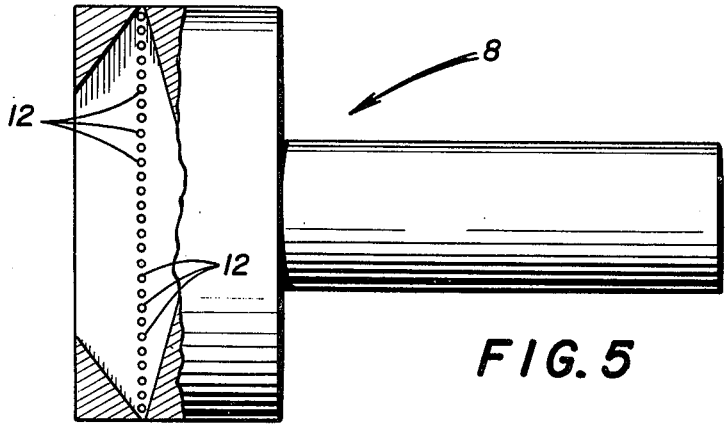
FIG. 5 is a side elevation of the spinner, partially in section, to schematically show location of the holes.

A second embodiment of the instant invention developed solely for the purpose of cleaning dust and dirt from the fiber fed into conventional open end spinners would operate as follows: referring to isometric drawing FIG. 4, and cross-sectional FIG. 5, a multiplicity of very fine holes 12, 0.018 inches in diameter are located in equal spaces around the vertex of the V-groove of a conventional open end spinner 8. For this embodiment of the invention it was found that approximately 100 equally spaced holes were optimum for removing dust and dirt particles from fiber feed. Thus, the spinner is converted into a type of selective filter which allows dirt, dust and foreign material to be centrifugally ejected through the multiplicity/plurality of fine holes 12 which the fibers 6 are retained in spinner 8 for subsequent formation into yarn. Except as described above, the process and mode of operation is the same as the particular spinner is intended to operate by the manufacturer. The major difference is in the addition and location of holes which produces the desired end result.

The open-face open-end spinner is usually described as being comprised of two main sections or parts. The first or forward part consists of a cylinder lying in the horizontal plane. This forward section is uniquely designed to gather fiber and spin it into yarn. Therefore, the forward section usually has a diameter several times greater than its length. Since the forward section has a critically hollow design, the entrance opening is much smaller or less wide than the exit opening. This is to allow for efficient receiving of fiber feed stock from the individualizer. The fiber is spun into a pile forming a yarn and exited into the second section of the aponner which is hollow and substantially forms a hollow cylindrical tube. Hence the exit opening is much smaller than the entrance opening. The yarn thus formed is then exited out of the second section into the take out rollers. Therefore, the first hollow section must be designed into a hollow V-groove to achieve this efficient yarn forming means and is designed as follows: referencing FIG. 2 and FIG. 3. it will be seen that the spinner is hollowed from the wide entrance opening angularly to the periphery of the outer walls of the cylinder and back to the narrow exit opening. The V-groove angle thus formed by angling the hollow from the wide entrance opening to the wall of the periphery of the cylinder and angling back again to the exit opening will form the configurated angle of 51°, at the wall of the cylinder.

Only a thin outer wall is left at the vertex of the angle. It is through this thin outer wall at the vertex of the angle that the fine holes are spaced and drilled around the entire circumference. This angle can be further described by passing an imaginary vertical plane through the vertex of the hollow V-groove thus formed. (See FIG. 3) The complimentary angles formed in the V-groove would be 37° on the opening side of the vertical and 14° on the exit side of the vertical. They are thus formed because the entrance opening is wider than the exit opening. Hence when the spinner is rotating the fibers pile up and form yarn and are subsequently ejected through the hollow cylindrical tube and then through the take out rollers.

Having thus described my invention, I claim:

1. An apparatus for the removal of dust, dirt, and foreign material from fiber feedstock and the production of a better quality and more efficient yarn comprising in combination:

a. a cylindrical forward or first section horizontally positioned, said cylinder diameter several times greater than its length, said first section also critically designed with a hollow V-groove center to receive, gather, and spin fiber feedstock into yarn, said critically designed hollow center described as follows:

1. a wide entrance opening to allow for efficient gathering of fiber feedstock said entrance opening hollowed back at an angle to the periphery of the outer cylinder wall leaving only a thin outer wall in the vertex of the V-groove, said vertex of said V-groove defined by passing an imaginary vertical plane through the vertexes formed in the cross-sectional view of the said open end spinner thus forming complimentary angles with 37° on the entrance opening side of said vertical plane and 14° on the exit opening side, and said thin wall perpherated in equal spaces with holes around the entire circumference in the vertex at the base of the V-groove forming a plurality of equally sized, equally spaced holes and said hollow center leading into a narrow exit opening which then leads into b. a second or aft section, said second/aft section comprising a hollow tube affixed to the exit of the said first section, said second section also being positioned in the horizontal.

2. The apparatus as defined in claim 1 wherein the angle of the vertex formed at the outer cylinder wall is 51°.

3. The apparatus as defined in claim 1 wherein there are approximately 200 equally spaced holes around the vertex of the V-groove each hole 0.018 inches in diameter.

4. The apparatus as defined in claim 1 wherein there are approximately 100 equally spaced holes around the vertex of the V-groove of the spinner 0.018 inches in diameter thereby converting the spinner essentially into a cleaning apparatus.

* * * * *